US005847651A

United States Patent [19]

Lu

[11] Patent Number: 5,847,651

[45] Date of Patent: Dec. 8, 1998

[54] SAFETY HELMET WITH ALARM MEANS FOR CALLING FOR HELP

[76] Inventor: Yao Lu, 4F-2, No. 79, Sec. 2, Lo Szu Fu Rd., Taipei City, Taiwan

[21] Appl. No.: 46,729

[22] Filed: Mar. 24, 1998

[51] Int. Cl.[6] ..... G08B 23/00

[52] U.S. Cl. ..... 340/573; 340/689; 340/691; 2/410

[58] Field of Search ..... 340/573, 689, 340/691, 331, 529; 2/5, 410

[56] References Cited

U.S. PATENT DOCUMENTS 4,680,815 7/1987 Hirsch et al. ..... 2/171.3
4,899,133 2/1990 Bartlett ..... 340/689
5,035,239 7/1991 Edwards ..... 128/205.23
5,090,054 2/1992 Grilliot et al. ..... 2/410
5,200,736 4/1993 Coombs et al. ..... 340/573
5,697,099 12/1997 Siska, Jr. et al. ..... 2/5

*Primary Examiner*—Jeffery Hofsass
*Assistant Examiner*—Anh La
*Attorney, Agent, or Firm*—Rosenberg, Klein & Bilker

[57] ABSTRACT

A safety helmet having an alarm device, which automatically gives an audio alarm signal to call for help upon an accident, and a fan for ventilation, the alarm device having signal lamps controlled by a first switch to flash when the safety helmet is put on the head, and an alarm control circuit controlled by a second switch to produce an audio alarm signal through a buzzer when the user loses consciousness due to an accident and the safety helmet falls with the user to the ground.

8 Claims, 5 Drawing Sheets

SAFETY HELMET WITH ALARM MEANS FOR CALLING FOR HELP

BACKGROUND OF THE INVENTION

The present invention relates to safety helmets, and more specifically to a safety helmet with alarm means which automatically gives an audio alarm signal to call for help when the user falls to the ground due to an accident.

A variety of safety helmets are provided for use in different conditions for different purposes. Regular safety helmets are designed with the considerations of protecting the head against impact and providing satisfactory ventilation. A safety helmet may be provided a signal lamp for giving a visual signal. These conventional safety helmets may effective for protecting the head, however they cannot automatically provide an alarm signal to call for help if the user loses consciousness due to sick or an accident.

SUMMARY OF THE INVENTION

The present invention has been accomplished under the circumstances in view. It is one object of the present invention to provide a safety helmet which automatically produces an audio alarm signal to call for help if the user loses consciousness due to sick or an accident. It is another object of the present invention to provide a safety helmet which has ventilation means that admits fresh air and let out foul air. To achieve these and other objects of the present invention, there is provided a safety helmet which comprises an outer shell, and inner shell mounted inside the outer shell, the inner shell having a plurality of air vents, a fan mounted on the outer shell for causing currents of air for ventilation, and an alarm device mounted on the outer shell at a rear side thereof, the alarm device comprising a buzzer, first switch means, second switch means, an alarm control circuit controlled by the second switch means to produce an audio alarm signal through the buzzer, and at least one signal lamp controlled by the first switch means to produce a visual signal, the at least one signal lamp and the alarm control circuit being connected in parallel to the first switch means, the alarm control circuit being connected in series to the first switch means through the second switch means, the first switch means being switched on and the second switch means being switched off when the user puts the safety helmet on the head, the second switch means being automatically switched on when tilted with the safety helmet over a predetermined angle, or automatically switched off when maintained with the safety helmet in horizontal.

DETAILED DESCRIPTION OF THE PREFERRED EMBODIMENT

Figure 1:
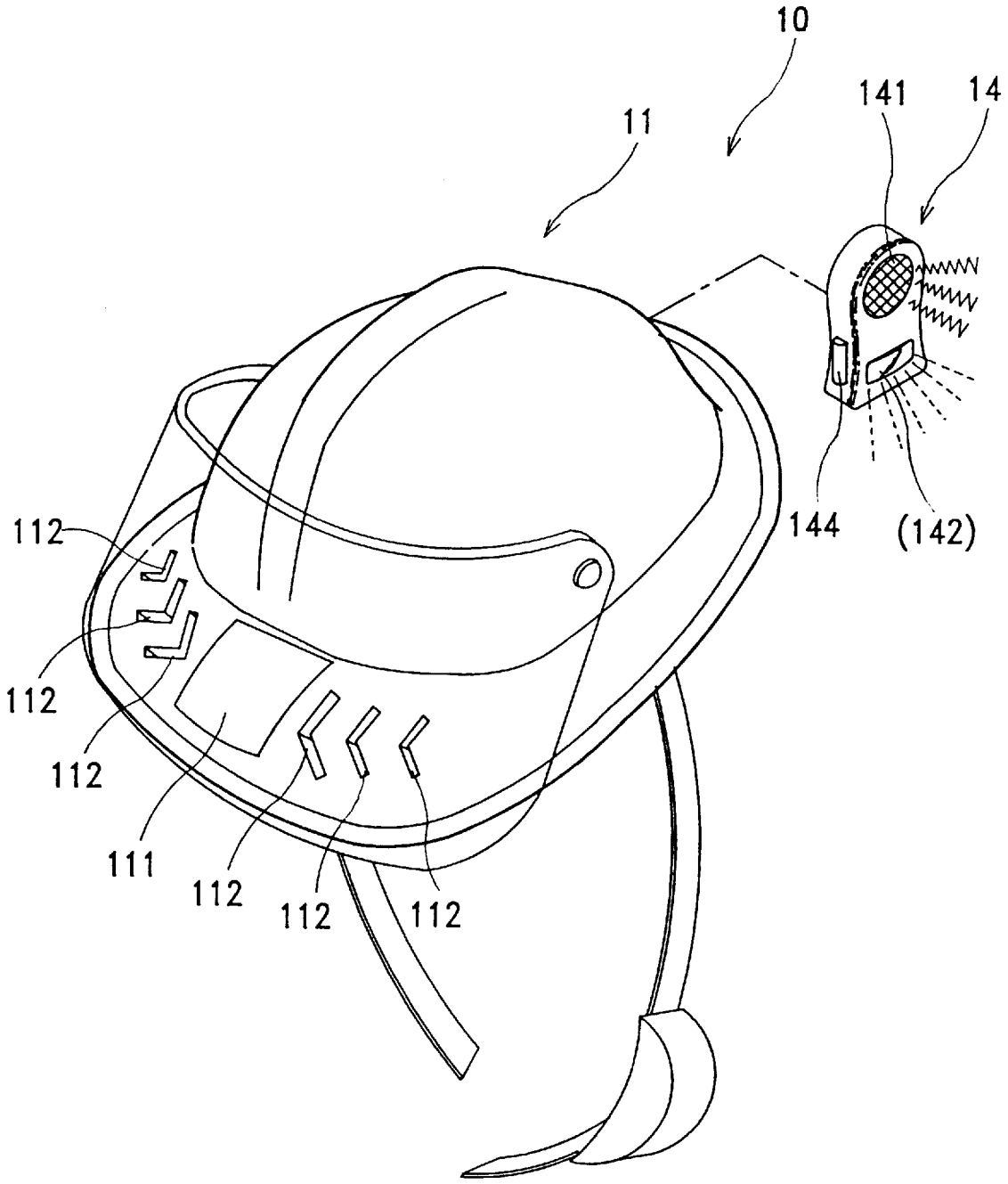
FIG. 1 is a perspective view of a safety helmet with the alarm device detached from the outer shell according to the present invention.

Referring to FIG. 1, a safety helmet in accordance with the present invention comprises an outer shell 11, an alarm device 14 mounted on the rear side of the outer shell 11. The alarm device 14 comprises a buzzer 141 and a plurality of signal lamps 142 at the front side thereof, and an on/off switch 144 at one lateral side thereof.

Figure 2:
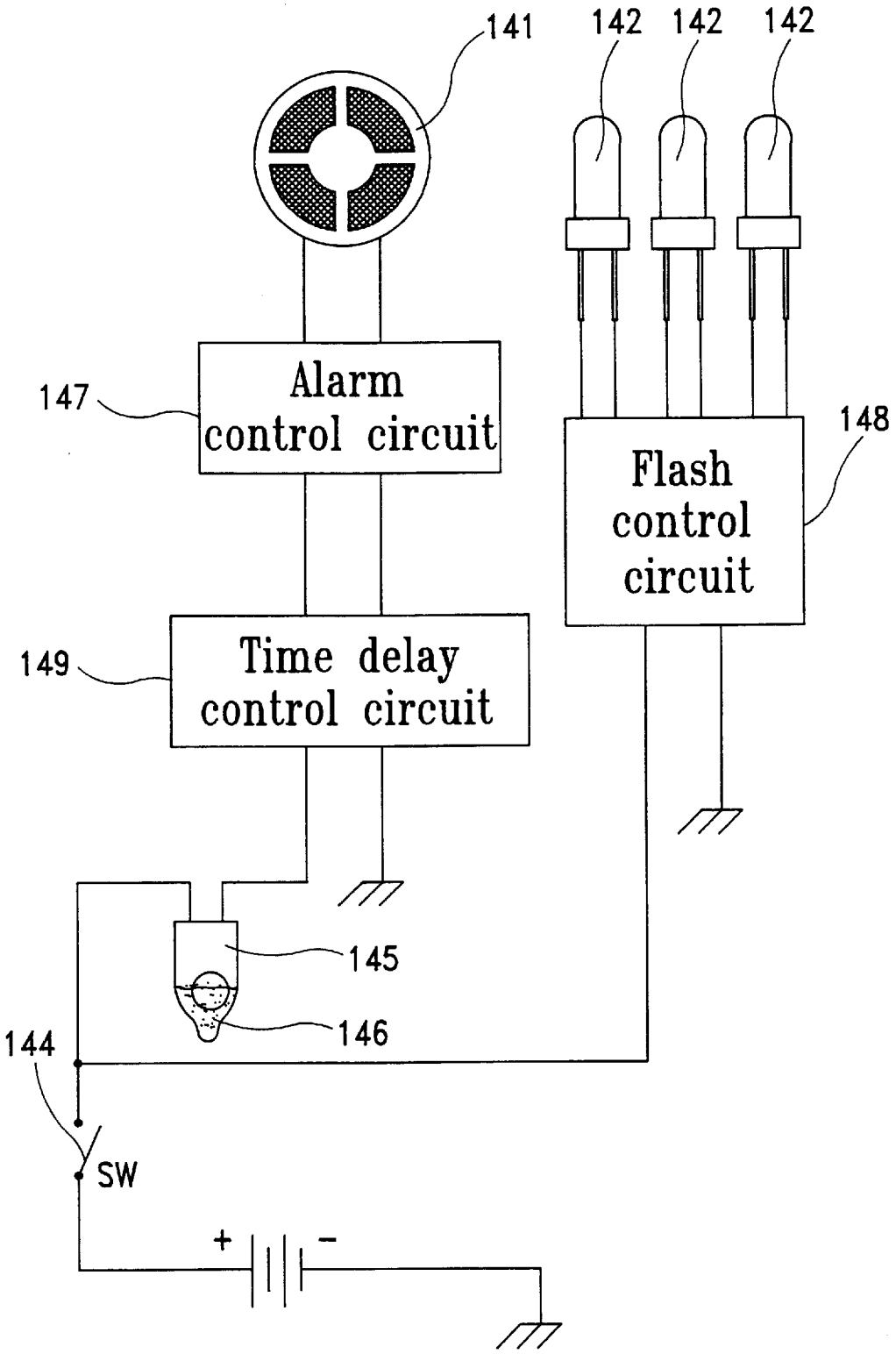
FIG. 2 is a circuit diagram of the alarm device for the safety helmet shown in FIG. 1.

Referring to FIG. 2 and FIG. 1 again, electric energy for the buzzer 141 and the signal lamps 142 is obtained from a battery through the control of the on/off switch 144. When the safety helmet is put on the head, the on/off switch 144 is switched on, causing a flash control circuit 148 to flash the signal lamps 142, and at the same time a control switch 145 is switched off to turn off the buzzer 141. The control switch 145 can be for example a mercury switch in which fluid mercury flows between two contacts to switch on/off the circuit subject to the angle of the control switch 145. If the user falls to the ground due to an accident, the safety helmet 10 is tilted, causing the control switch 145 to be switched on. If the control switch 145 is still maintained "on" after a predetermined length of time, the time delay control circuit, referenced by 149, immediately drives an alarm control circuit 147 to produce an audio alarm signal through the buzzer 141.

Figure 3:
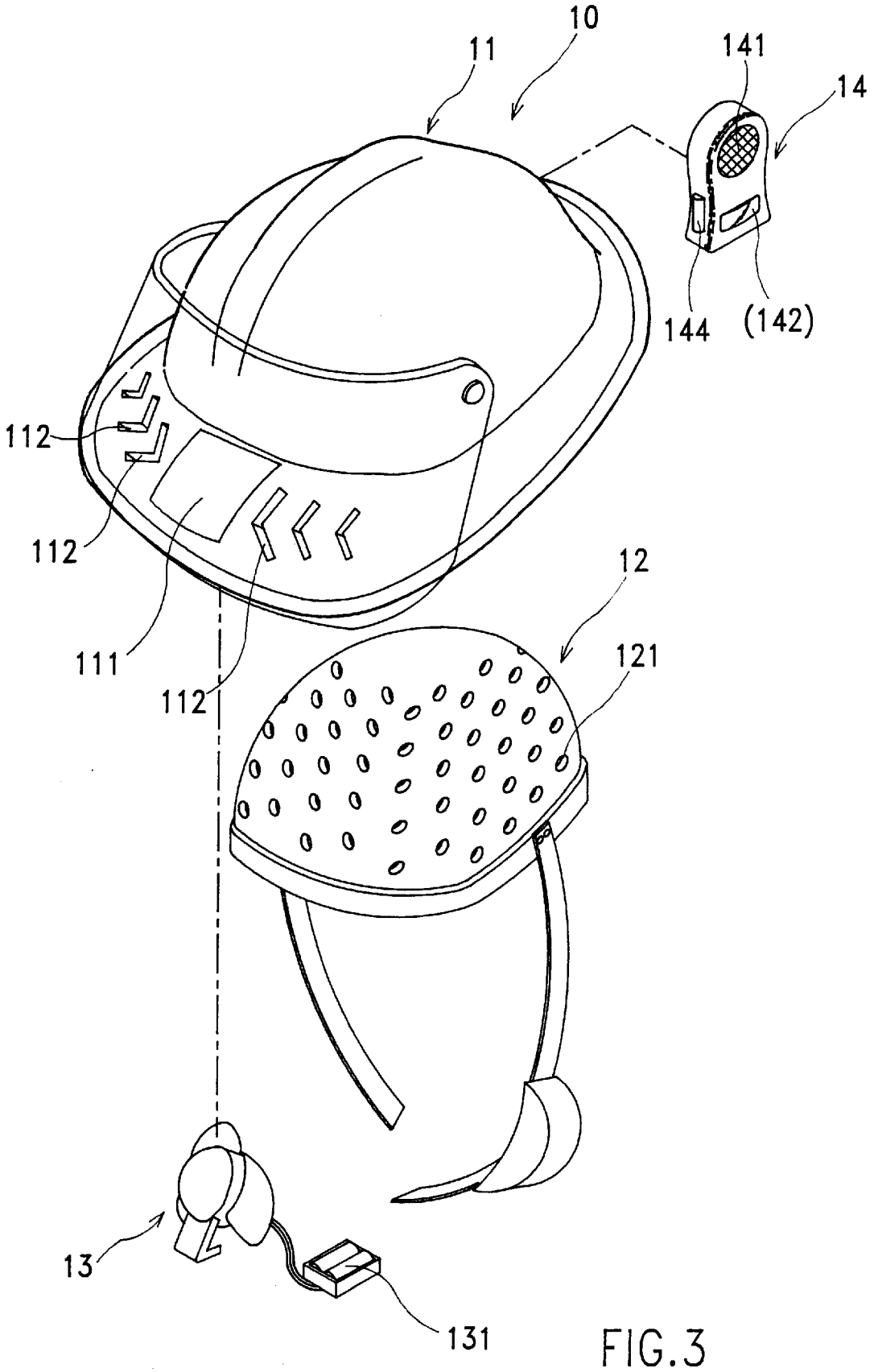
FIG. 3 is an exploded view of the safety helmet shown in FIG. 1.
Figure 4:
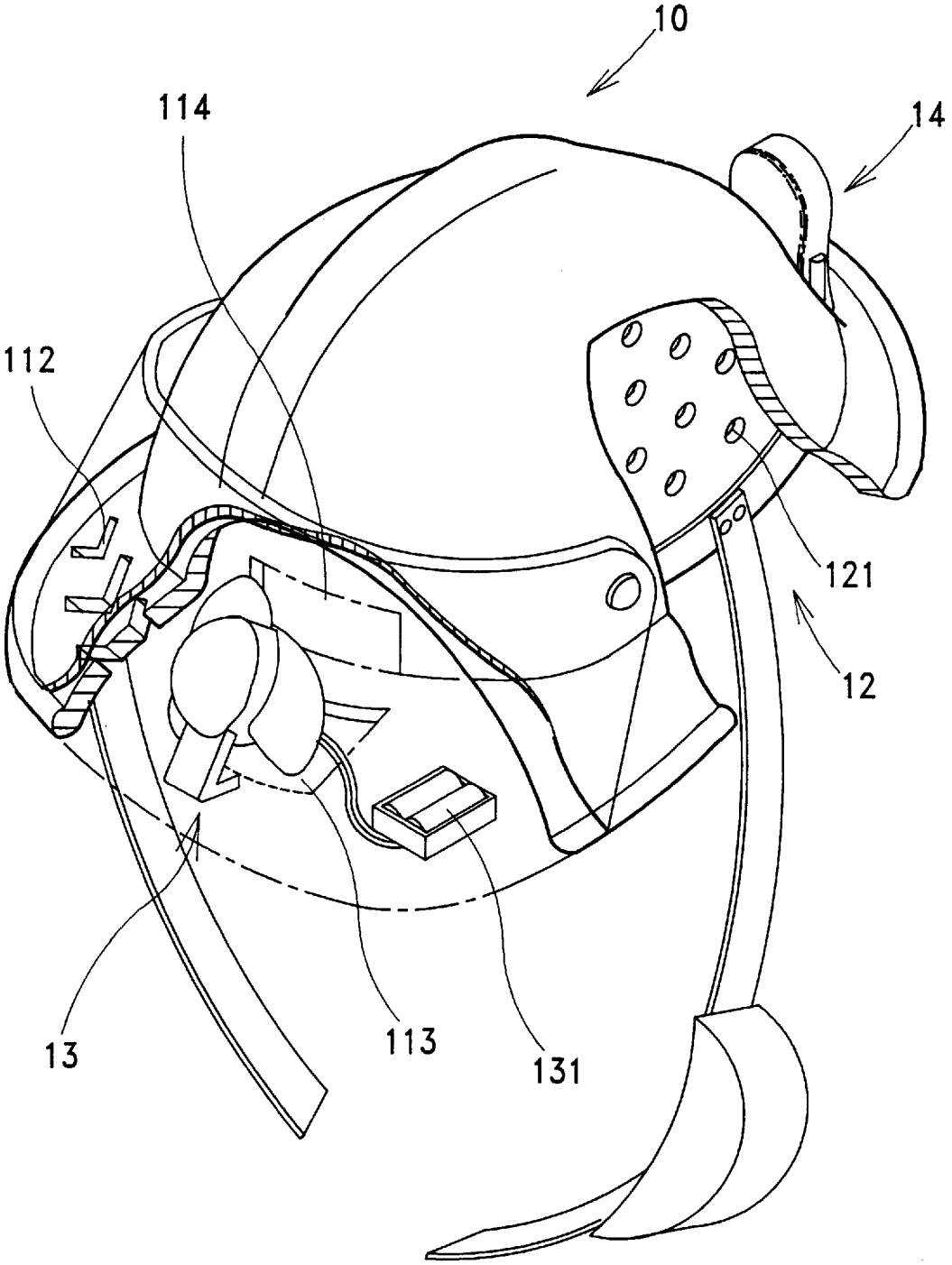
FIG. 4 is sectional elevational view of the present invention, showing the fan and the battery box mounted inside the outer shell.

Referring to FIGS. 3 and 4, the safety helmet 10 further comprises an perforated inner shell 12 mounted inside the outer shell 11. The perforated inner shell 12 may be molded from for example foamed polyurethane, having a plurality of air vents 121 for ventilation. An electric fan 13 and a battery box 131 are mounted inside the visor of the outer shell 11. A shield 111 is mounted on the outer shell 11 at the front side for protection. A suction hole 113 is provided at the bottom side of the visor of the outer helmet 11 right behind the fan 113. Excessive amount of intake air is guided out of the safety helmet 10 through the suction hole 113. An air intake hole 114 is provided at the front side of the crown of the outer shell 11 through which currents of air are guided into the inside of the outer shell 11 and the inside of the inner shell 12 through the air vents 121 on the inner shell 12.

Figure 5:
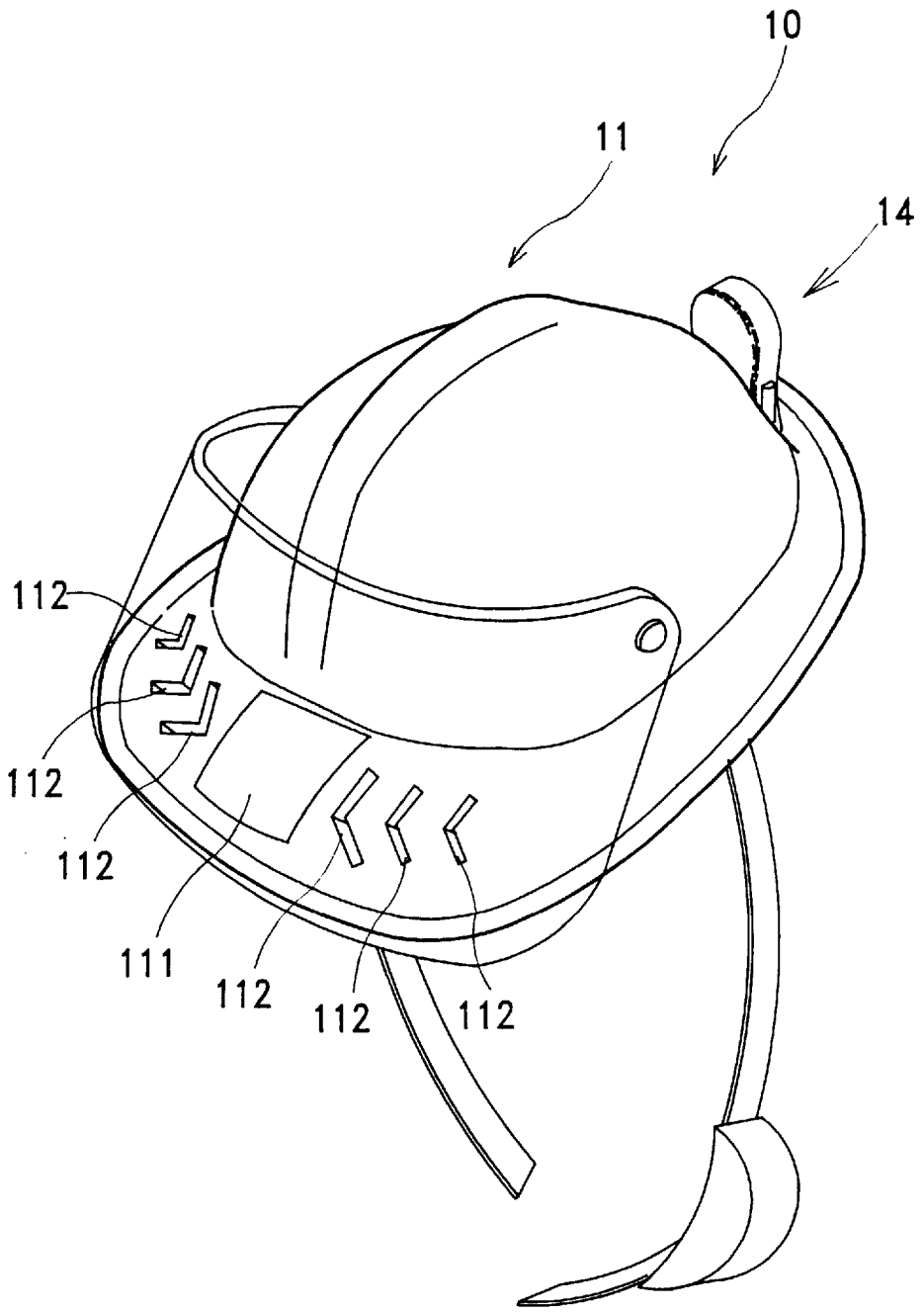
FIG. 5 is a perspective view of the present invention.

Referring to FIG. 5, the shield 111 is provided at the front side of the outer shell 11 of the safety helmet 10, and the outer shell 11 is provided with a plurality of air tunnels 112 arranged at two sides of the fan 113 (see also FIG. 4) for guiding currents of air to the inside of the safety helmet 10. When the user rides a motorcycle, currents of natural air is induced into the inside of the safety helmet 10 through the air tunnels 112.

It is to be understood that the drawings are designed for purposes of illustration, and are not intended as a definition of the limits and scope of the invention disclosed.

What the invention claimed is:

1. A safety helmet comprising an outer shell, and inner shell mounted inside said outer shell, said inner shell having a plurality of air vents, a fan mounted on said outer shell for causing currents of air for ventilation, an alarm device mounted on said outer shell at a rear side thereof, and battery power supply which provides electric energy to said fan and said alarm device, said alarm device comprising a buzzer, first switch means, second switch means, an alarm control circuit controlled by said second switch means to produce an audio alarm signal through said buzzer, and at least one signal lamp controlled by said first switch means to produce a visual signal, said at least one signal lamp and said alarm control circuit being connected in parallel to said first switch means, said alarm control circuit being connected in series to said first switch means through said second switch means, said first switch means being switched on and said second switch means being switched off when the user puts the safety helmet on the head, said second switch means being automatically switched on when tilted with the safety helmet over a predetermined angle, or automatically switched off when maintained with the safety helmet in horizontal.

2. The safety helmet of claim 1, wherein said second switch means comprises two vertically spaced contacts and an electrically conductive fluid material moved between said vertically spaced contacts, said electrically conductive fluid material connecting said vertically spaced contacts to switch on the circuit when said second switch means is turned to a vertical position, said electrically conductive fluid material is moved on one contact to switch off the circuit when said second switch means is maintained in a horizontal position.

3. The safety helmet of claim 1 further comprising a time delay control circuit connected in series between said alarm control circuit and said second switch means, said time delay control circuit driving said alarm control circuit to produce an audio alarm signal through said buzzer a predetermined length of time after said second switch means is switched on.

4. The safety helmet of claim 1, wherein said outer shell is provided with a shield at a front side over a visor thereof to protect said fan, the visor of said outer shell having a plurality of air vents.

5. The safety helmet of claim 1, wherein said at least one signal lamp includes a plurality of signal lamps controlled to flash.

6. The safety helmet of claim 5 further comprising a flash control circuit which controls the flashing frequency of said signal lamps.

7. The safety helmet of claim 1, wherein said outer shell has a plurality of air tunnels at two sides of said fan for guiding currents of air into the air vents on said inner shell.

8. The safety helmet of claim 1, wherein said inner shell is molded from foamed polyurethane.

* * * * *